US006400375B1

(12) United States Patent
Okudaira

(10) Patent No.: US 6,400,375 B1
(45) Date of Patent: Jun. 4, 2002

(54) INFORMATION PROCESSING APPARATUS AND METHOD AS WELL AS PROVIDING MEDIUM

(75) Inventor: Koushin Okudaira, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/384,636

(22) Filed: Aug. 27, 1999

(30) Foreign Application Priority Data

Aug. 31, 1998 (JP) ..... 10-244664

(51) Int. Cl.[7] ..... G09G 5/26
(52) U.S. Cl. ..... 345/668; 345/667; 345/669
(58) Field of Search ..... 345/127, 129, 345/130, 132, 339, 342, 668, 669, 667, 657

(56) References Cited

U.S. PATENT DOCUMENTS 5,073,771 A * 12/1991 Satta et al. ..... 345/115
5,172,103 A * 12/1992 Kita ..... 345/127
5,781,175 A * 7/1998 Hara ..... 345/127
5,856,821 A * 1/1999 Funahashi ..... 345/127
5,969,706 A * 10/1999 Tanimoto et al. ..... 345/127
6,037,939 A * 3/2000 Kashiwagi et al. ..... 345/342
6,169,547 B1 * 1/2001 Tanaka et al. ..... 345/127

* cited by examiner

*Primary Examiner*—Matthew Luu
(74) *Attorney, Agent, or Firm*—Oblon, Spivak, McClelland, Maier & Neustadt, P.C.

(57) ABSTRACT

An information processing apparatus and method as well as a providing medium which allow thumbnail images to be displayed in an arbitrary size designated by a user thereby to allow efficient management of image data. A setting inputting section detects and outputs parameters set by a user to an arithmetic section. The arithmetic section calculates one of a horizontal number or a vertical number of thumbnail images to be displayed at a time in an image display region and outputs the calculated number to a decision section. The decision section rounds the value inputted from the arithmetic section into an integer based on a predetermined criterion to obtain an integral value. The decision section further determines a width and a height for a thumbnail image using the integral value and outputs the values to a display control section. The display control section reads out image data stored in a storage section, reduces images of the image data so that each of the images may remain in a thumbnail image having the width and the height inputted from the decision section and causes the images to be displayed in the image display region.

15 Claims, 10 Drawing Sheets

INFORMATION PROCESSING APPARATUS AND METHOD AS WELL AS PROVIDING MEDIUM

BACKGROUND OF THE INVENTION

This invention relates to an information processing apparatus and method as well as a providing medium, and more particularly to an information processing apparatus and method as well as a providing medium which allow efficient management of image data.

Software for displaying an image reduced in size from an image of image data, that is, a thumbnail image, and managing a plurality of image data is available. Such software allows designation of image data for which predetermined processing such as, for example, display, storage or erasure of image data should be performed in response to selection of one of thumbnail images displayed. Consequently, when compared with designation of an image file based on text information such as, for example, a file name, efficient image management is allowed.

Software for use to manage image data using existing thumbnail images, however, is disadvantageous in that the size of thumbnail images is fixed, or even if the size is variable, selection only from among several sizes set in advance is allowed and the user cannot arbitrarily set the size of a thumbnail image.

The software described above is disadvantageous also in that the number of thumbnail images which can be displayed at a time on a screen is restricted.

Therefore, the software is further disadvantageous in that, where the number of thumbnail images (number of image data) managed is comparatively small, a considerably large area which does not display a thumbnail image appears on the screen. On the contrary where the number of thumbnail images managed is large, all of the thumbnail images cannot be displayed in the display area of the screen and such an operation as to scroll the display area is required.

SUMMARY OF THE INVENTION

It is an object of the present invention to provide an information processing apparatus and method as well as a providing medium which allow thumbnail images to be displayed in an arbitrary size designated by a user thereby to allow efficient management of image data.

In order to attain the object described above, according to an aspect of the present invention, there is provided a plural image displaying method, comprising the steps of setting an aspect ratio for a plurality of images, setting an aspect ratio of a region in which the plurality of images should be displayed, setting the number of the images to be displayed in the region, determining, from the aspect ratio for the plurality of images, the aspect ratio of the region and the number of the images, a size of the images when the images should be displayed in the region, and displaying the plurality of images with the determined size in the region.

According to another aspect of the present invention, there is provided a plural image displaying apparatus, comprising a display screen, means for providing information of a plurality of images to be displayed on the display screen, means for setting an aspect ratio for the plurality of images, means for setting an aspect ratio of a region of the display screen in which the plurality of images should be displayed, means for setting the number of the images to be displayed in the region, means for determining, from the aspect ratio for the plurality of images, the aspect ratio of the region and the number of the images, a size of the images when the images should be displayed in the region, and control means for controlling the display screen to display the plurality of images with the determined size in the region.

According to a further aspect of the present invention, there is provided a providing medium which provides a computer-readable program for causing an information processing apparatus to execute a process comprising the steps of setting an aspect ratio for a plurality of images, setting an aspect ratio of a region in which the plurality of images should be displayed, setting the number of the images to be displayed in the region, determining, from the aspect ratio for the plurality of images, the aspect ratio of the region and the number of the images, a size of the images when the images should be displayed in the region, and displaying the plurality of images with the determined size in the region.

In the plural image displaying method and apparatus and the providing medium, the aspect ratio for the plurality of images may be determined from a vertical length and a horizontal length of each of the plurality of images.

The aspect ratio of the region in which the plurality of images should be displayed may be determined from a vertical length and a horizontal length of the region in which the plurality of images should be displayed. In this instance, the vertical length and the horizontal length of the region in which the plurality of images should be displayed may individually be variable.

The number of the images to be displayed in the region may be the number of image files included in a predetermined folder.

With the plural image displaying method and apparatus and the providing medium, the size of the images when the images should be displayed in the region is determined from the aspect ratio for the plurality of images, the aspect ratio of the region and the number of the images, and the images are displayed with the determined size in the region. Consequently, image data of such images can be managed efficiently.

The above and other objects, features and advantages of the present invention will become apparent from the following description and the appended claims, taken in conjunction with the accompanying drawings in which like parts or elements denoted by like reference symbols.

DESCRIPTION OF THE PREFERRED EMBODIMENT

Figure 1:
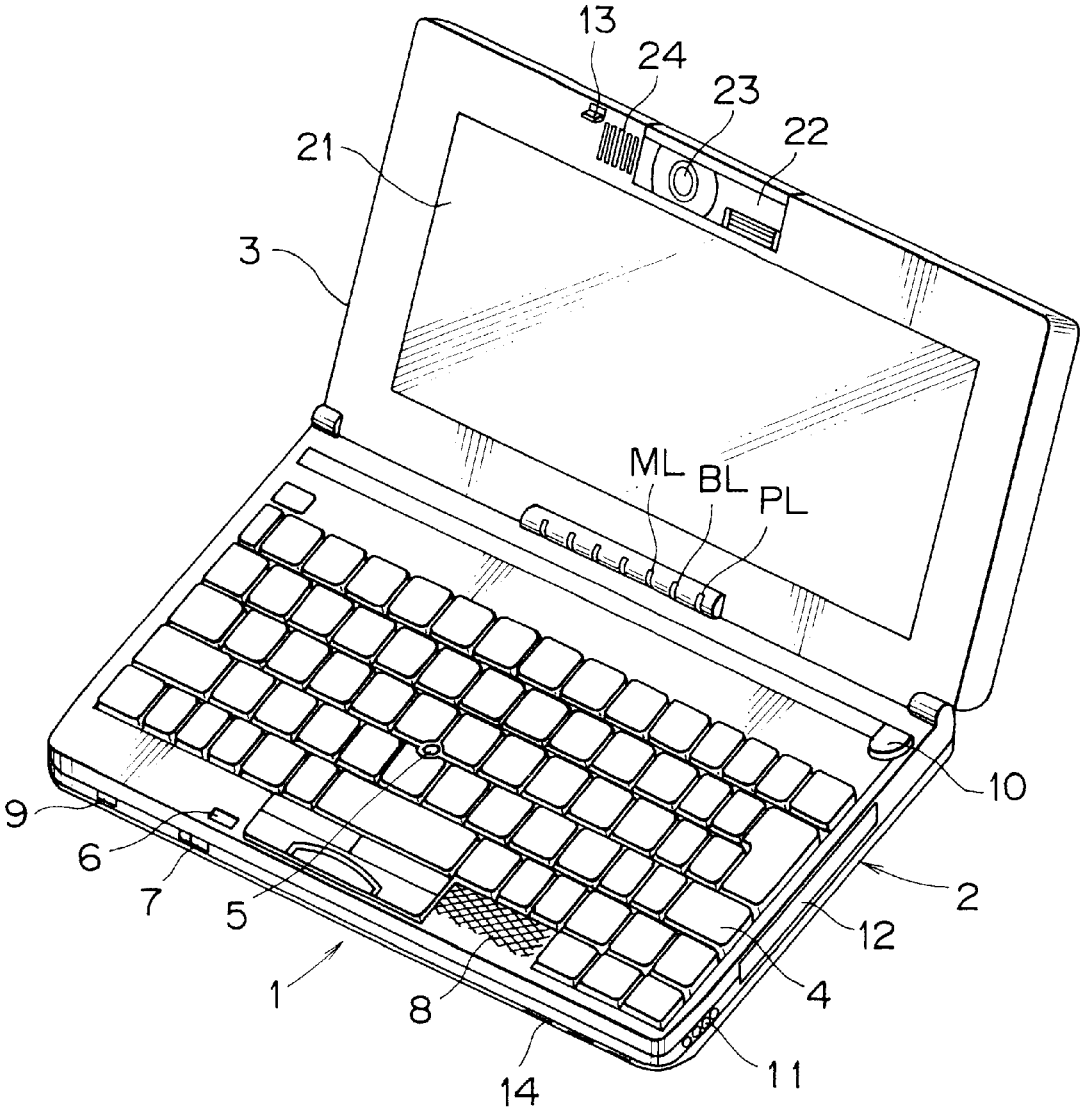
FIG. 1 is a perspective view showing a personal computer to which the present invention is applied.
Figure 2:
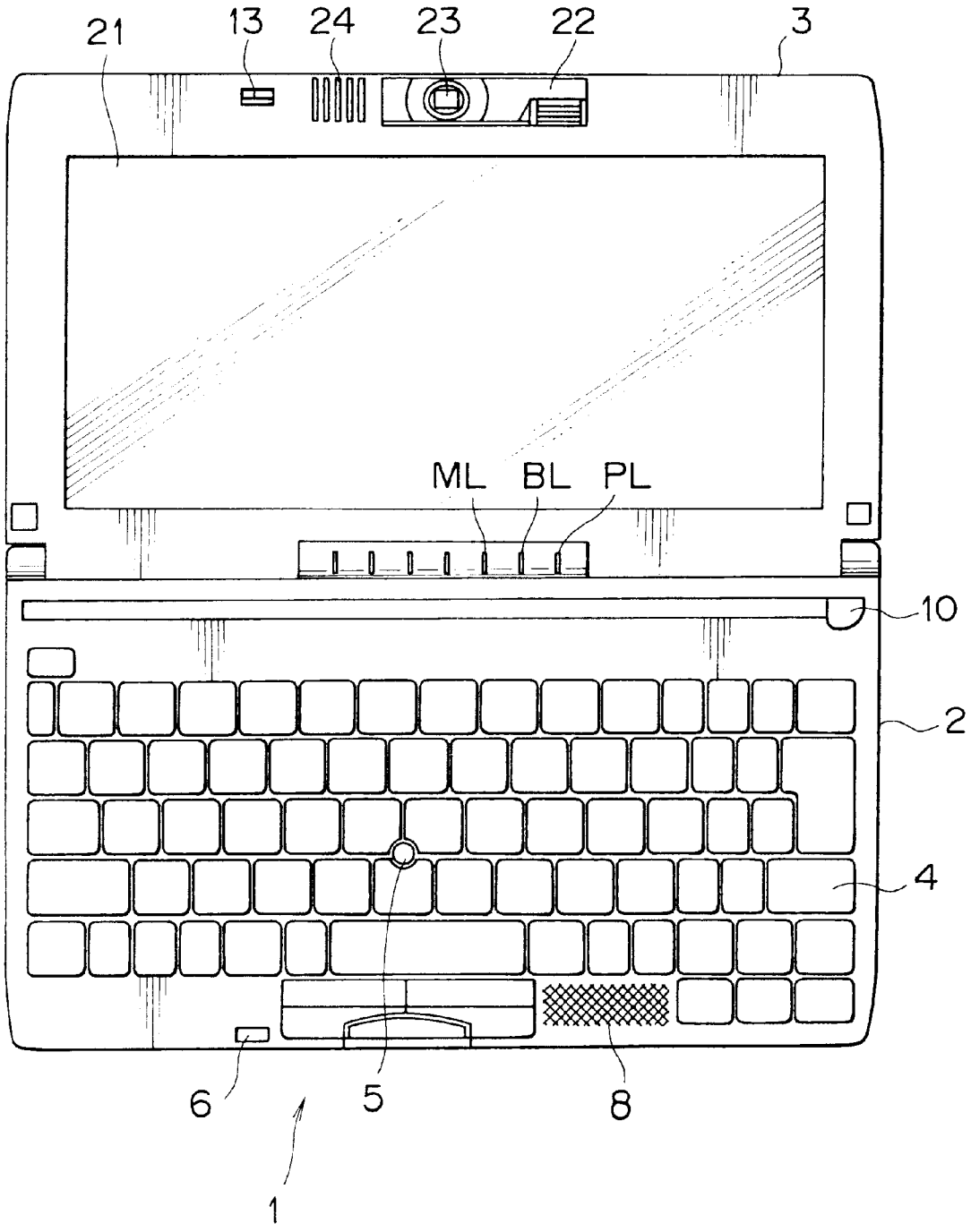
FIG. 2 is a plan view of the personal computer shown in FIG. 1.
Figure 3:
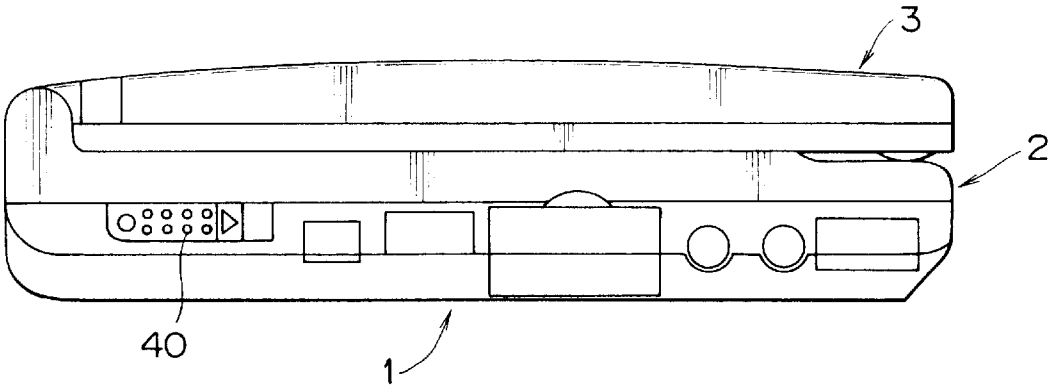
FIG. 3 is a left-hand side elevational view of the personal computer of FIG. 1 when the display section is closed with respect to the body.
Figure 4:
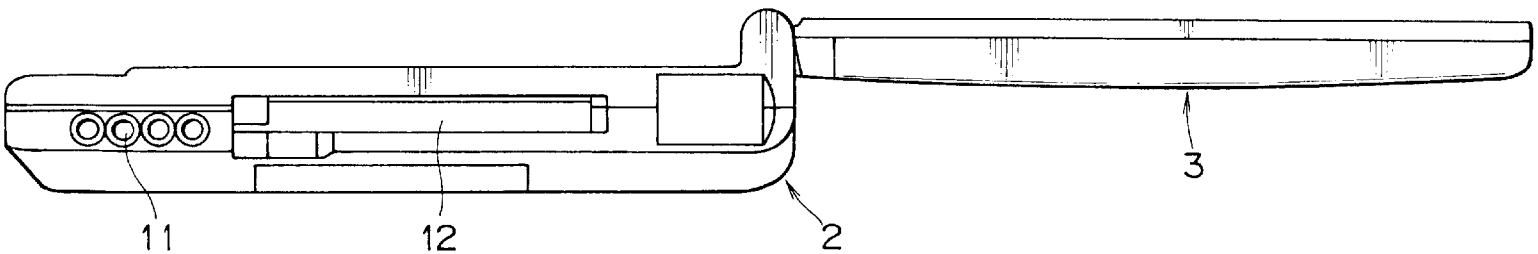
FIG. 4 is a right-hand side elevational view of the personal computer of FIG. 1 but when the display section is pivotally opened by 180 degrees with respect to the body.
Figure 5:
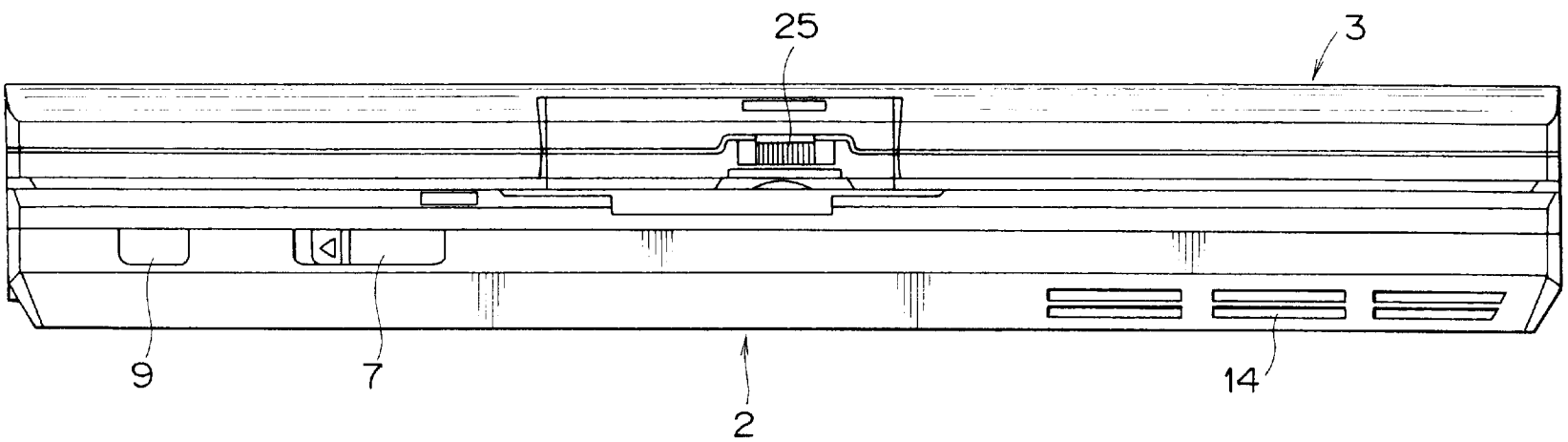
FIG. 5 is a front elevational view of the personal computer shown in FIG. 3.
Figure 6:
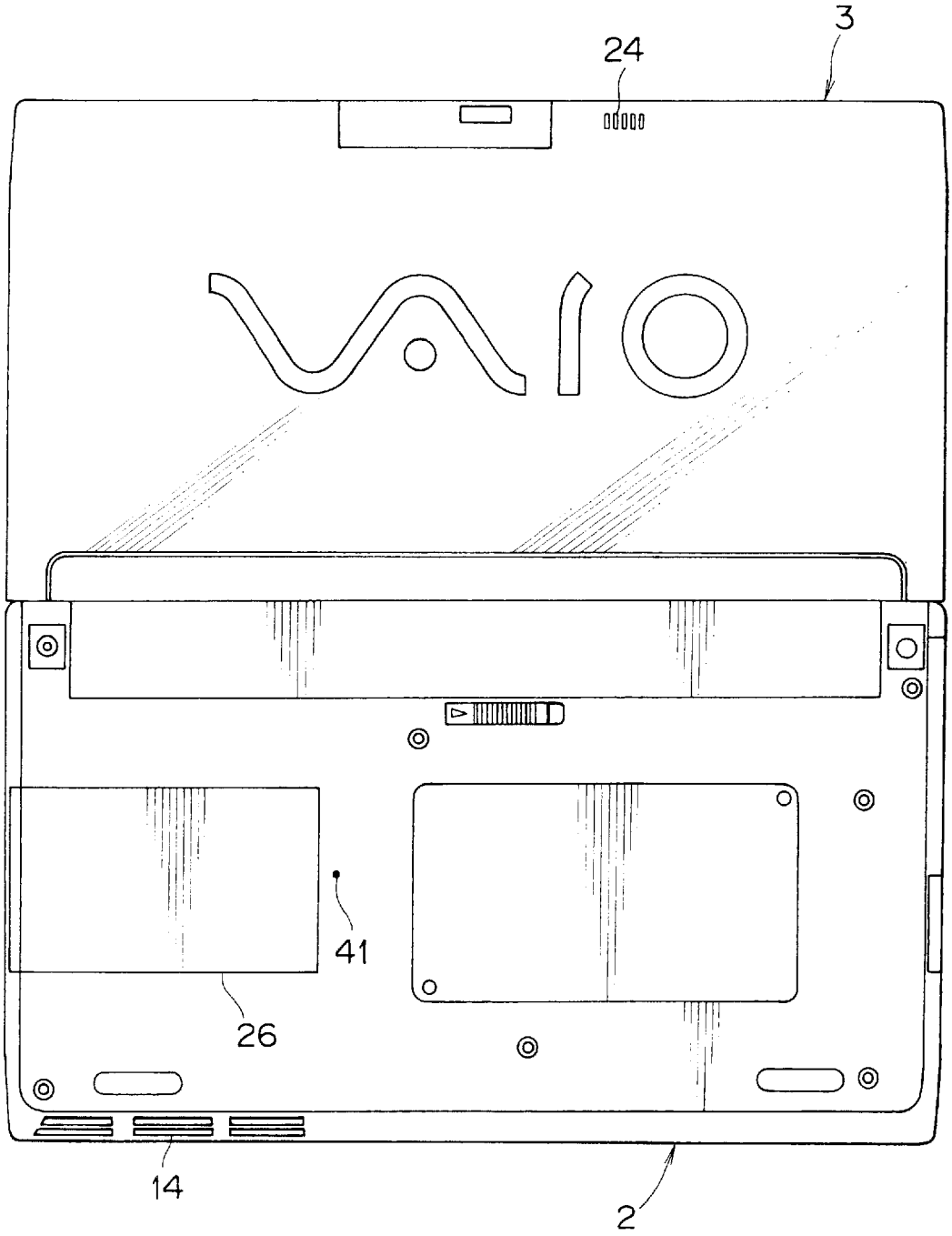
FIG. 6 is a bottom plan view of the personal computer shown in FIG. 4.

Referring first to FIGS. 1 to 6, there is shown a portable personal computer to which the present invention is applied. The personal computer generally denoted at 1 is a personal computer of the mini notebook type and includes, as basic components thereof, a body 2 and a display part 3 mounted for pivotal opening and closing movement with respect to the body 2 along an axis extending along a direction of the rear side of the body 2. FIG. 1 is a perspective view of the personal computer 1 when the display part 3 is opened with respect to the body 2; FIG. 2 is a plan view of the personal computer 1 shown in FIG. 1; FIG. 3 is a left-hand side elevational view illustrating the personal computer 1 with the display part 3 closed with respect to the body 2; FIG. 4 is a right-hand side elevational view illustrating the personal computer 1 with the display part 3 opened by 180 degrees with respect to the body 2; FIG. 5 is a front elevational view of the personal computer 1 shown in FIG. 3 and FIG. 6 is a bottom plan view of the personal computer 1 shown in FIG. 4.

A keyboard 4 and a track point (trademark) 5 are mounted on an upper face of the body 2. The keyboard 4 is operated to input various characters, symbols and so forth, and the track point 5 is operated to move a mouse cursor and so forth. Also a speaker 8 which outputs sound and a shutter button 10 are provided on the upper face of the body 2. The shutter button 10 is operated to pick up an image of an object by means of a CCD video camera 23 which is provided on the display part 3.

A pawl 13 is provided at an upper end of the display part 3 in FIG. 1, and a hole 6 into which the pawl 13 is to be fitted is provided open at a position of the body 2 which opposes the pawl 13 when the display part 3 is closed with respect to the body 2 as seen in FIG. 3. A slide lever 7 is mounted on a front face of the body 2 for sliding movement in parallel to the front face of the body 2 to and from a position in which it engages with the pawl 13 fitted in the hole 6 to lock the pawl 13 and hence lock the display part 3 to its closed position. When the pawl 13 is unlocked from the slide lever 7, the display part 3 can be pivoted with respect to the body 2. A microphone 24 is mounted adjacent the pawl 13. The microphone 24 can collect sound also from the back of the personal computer 1 as seen from FIG. 6.

Also a programmable power key (PPK) 9 is provided in the front face of the body 2. An air outlet 11 is formed on a right-hand side wall of the body 2 as seen in FIG. 4, and an air inlet 14 is formed at a lower portion of the front face of the body 2 as seen in FIG. 5. A slot 12 for receiving a PCMCIA (Personal Computer Memory Card International Association) card (PC card) is formed on the right side of the air outlet 11.

An LCD (Liquid Crystal Display) 21 for displaying an image thereon is provided on the front face of the display part 3, and an image pickup part 22 is mounted at an upper end of the LCD 21 in FIG. 1 for pivotal motion with respect to the display part 3. In particular, the image pickup part 22 is mounted for turning to any position within a range of 180 degrees from the direction of the LCD 21 to the opposite direction. The CCD video camera 23 is mounted on the image pickup part 22.

A power supply lamp PL, a battery lamp BL, a message lamp ML and other necessary lamps which may be formed from light emitting diodes (LEDs) are provided at lower portions of the display part 3 in FIG. 1 adjacent the body 2. It is to be noted that reference numeral 40 shown in FIG. 3 denotes a power supply switch provided on the left side face of the body 2, and 25 shown in FIG. 5 denotes an adjustment ring for adjusting the focus of the CCD video camera 23. Further, reference numeral 26 shown in FIG. 6 denotes a lid which covers over an opening through which an add-on memory is to be loaded into the body 2, and reference numeral 41 denotes a small hole into which a pin for disengaging the locking pawl of the lid 26 is to be inserted.

Figure 7:
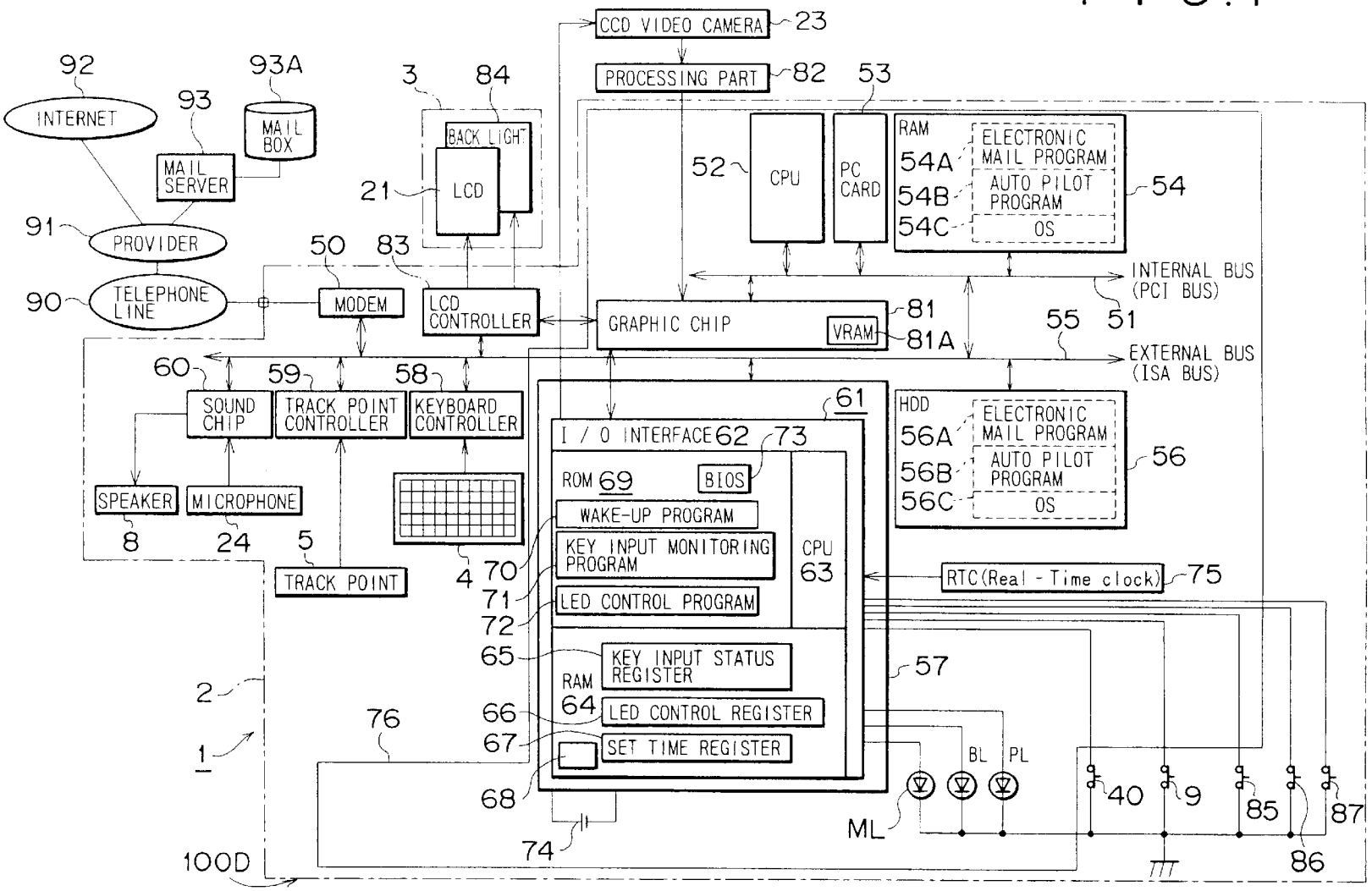
FIG. 7 is a block diagram showing an electric circuit of the personal computer of FIG. 1.

FIG. 7 shows an internal structure of the personal computer 1. Referring to FIG. 7, a CPU (Central Processing Unit) 52, a PC card 53 which is loaded into the personal computer 1 when necessary, a RAM (Random Access Memory) 54 and a graphic chip 81 are connected to an internal bus 51. The internal bus 51 is connected to an external bus 55, and a hard disk drive (HDD) 56, an I/O (input/output) controller 57, a keyboard controller 58, a track point controller 59, a sound chip 60, an LCD controller 83, a modem 50 and other required devices are connected to the external bus 55.

The CPU 52 serves as a controller for controlling various functions. The PC card 53 is suitably loaded in order to add an optional function to the personal computer 1.

The RAM 54 has, at a point of time when start-up is completed, an electronic mail program (application program) 54A, an auto pilot program (application program) 54B and an OS (operating system) 54C stored therein. The programs mentioned are transferred from the HDD 56 to the RAM 54.

The electronic mail program 54A is a program for sending or transferring an electronic message over a network such as a communication line such as a telephone line. The electronic mail program 54A has an in-coming mail capturing function as a particular function. The in-coming mail capturing function checks a mail box 93A of a mail server 93 for a mail addressed to that user and if such a mail is found, captures the same.

The auto pilot program 54B is a program for successively starting a plurality of processes (or programs) set in advance in a predetermined order.

The OS (basic program software) 54C controls basic operation of the computer represented by the Windows95 (trademark).

Meanwhile, the hard disk drive (HDD) 56 of the external bus 55 side has an electronic mail program 56A, an auto pilot program 56B and an OS (basic program software) 56C stored therein. The OS 56C, auto pilot program 56B and electronic mail program 56A in the hard disk drive 56 are successively transferred to and stored into the RAM 54 in a procedure of start-up (boot-up) processing. Also image data fetched by the CCD video camera 23 and processed by a processing part 82 are stored in the hard disk drive 56. Furthermore, an image management program (details of which are hereinafter described) for managing the image data is stored in the hard disk drive 56.

The I/O controller 57 includes a microcontroller 61 provided with an I/O interface 62. The microcontroller 61 includes, in addition to the I/O interface 62, a CPU 63, a RAM 64 and a ROM 69 which are connected to each other. The RAM 64 includes a key-input status register 65, an LED (light emitting diode) control register 66, a set time register 67, and a register 68. The set time register 67 is used to start operation of a start sequence controller 76 when a time (start-up condition) set in advance by the user comes. The register 68 stores a correspondence between a combination (start-up condition) of operation keys set in advance and an application program to be started up. When the stored combination of operation keys is inputted by the user, then the stored application program (for example, an electronic mail) is started up.

The key-input status register 65 stores an operation key flag when the programmable power key (PPK) 9 for single-touch operation is depressed. The LED control register 66 controls the turn-on/off of the message lamp ML which indicates a start-up condition of an application program (electronic mail program) stored in the register 68. The set time register 67 accepts setting of an arbitrary time.

A backup battery 74 is connected to the microcontroller 61 so that stored values of the registers 65, 66 and 67 may be maintained when the power supply to the body 2 is off.

The ROM 69 in the microcontroller 61 has a wake-up program 70, a key input monitoring program 71 and an LED control program 72 stored in advance therein. The ROM 69 is formed from, for example, an EEPROM (electrically erasable and programmable read only memory). The EEPROM is also called flash memory. Further, an RTC (Real-Time Clock) 75 which normally counts the present time is connected to the microcontroller 61.

The wake-up program 70 in the ROM 69 is a program for checking based on the present time data supplied thereto from the RTC 75 whether or not a time set in advance in the set time register 67 comes and starts up a predetermined process (or program) or the like when the set time comes. The key input monitoring program 71 is a program for normally supervising whether or not the programmable power key (PPK) 9 is depressed by a user. The LED control program 72 is a program for controlling the turn-on/off of the message lamp ML.

The ROM 69 further has a BIOS (Basic Input/Output System) 73 written therein. The BIOS is a basic input/output system and is a software program for controlling the transfer (input/output) of data between an OS or application software and a peripheral equipment such as display unit, a keyboard, or a hard disk drive.

The keyboard controller 58 connected to the external bus 55 controls inputting from the keyboard 4. The track point controller 59 controls inputting of the track point 5.

The sound chip 60 fetches an input from the microphone 24 or supplies an audio signal to the speaker 8.

The modem 50 connects the personal computer 1 to a communication network 92 such as the Internet or the mail server 93 through a public telephone line 90 or an Internet service provider 91.

The graphic chip 81 connected to the internal bus 51 receives, as input data thereto, image data captured by the CCD video camera 23 and processed in a processing part 82. The graphic chip 81 stores video data inputted thereto from the CCD video camera 23 through the processing part 82 into a VRAM (video RAM) 81A built therein and reads out and outputs the data suitably to the LCD controller 83. The LCD controller 83 outputs the image data supplied thereto from the graphic chip 81 to the LCD 21 so that they may be displayed on the LCD 21. A backlight 84 illuminates the LCD 21 from behind.

The power supply switch 40 is operated to switch the power supply on or off. A half depression switch 85 is switched on when the shutter button 10 is depressed into a half-depression condition. A full depression switch 86 is switched on when the shutter button 10 is depressed into a full-depression condition. A reversal switch 87 is switched on when the image pickup part 22 is turned by 180 degrees (when the CCD video camera 23 is turned to a direction to pick up an image on the opposite side to the LCD 21).

Now, the image management program stored in the hard disk drive 56 is described. The image management program is transferred to and stored into the RAM 54 from the hard disk drive 56 in response to a predetermined starting operation by a user and is executed by the CPU 52.

Figure 8:
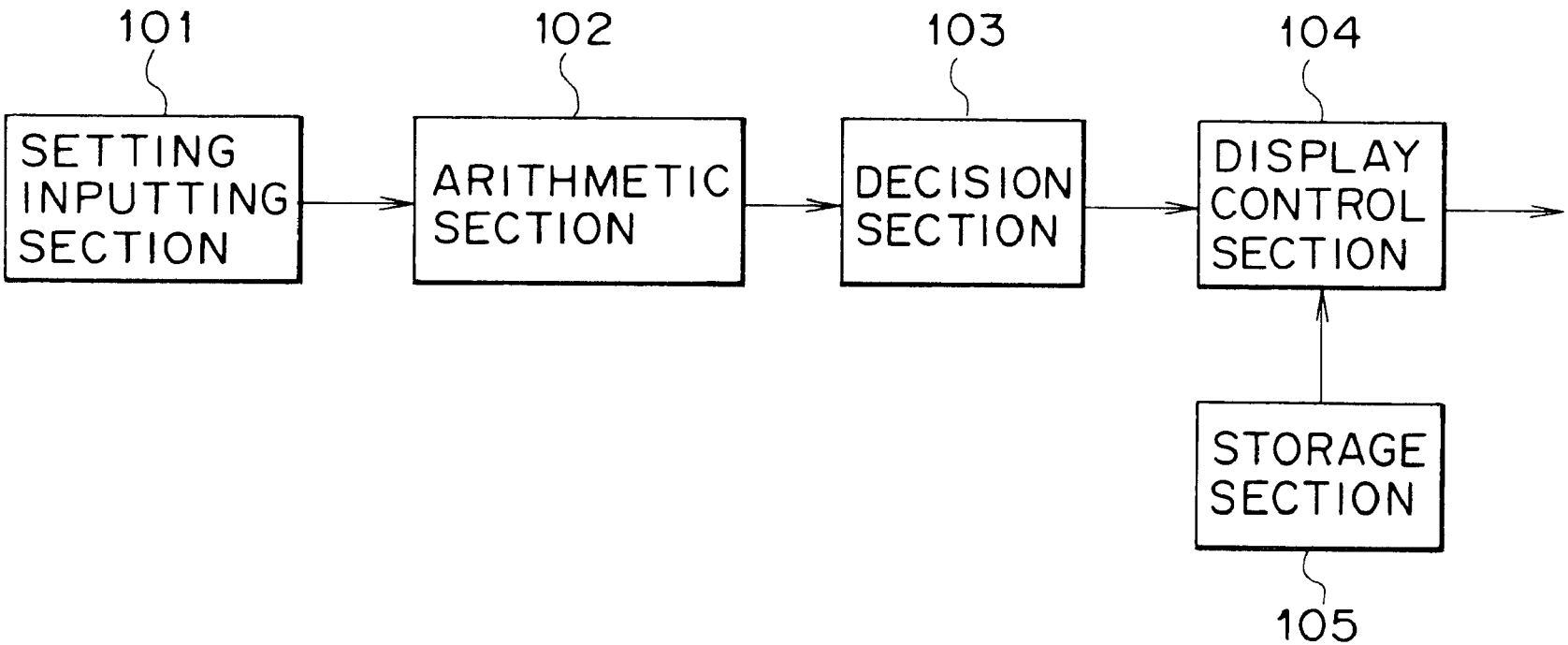
FIG. 8 is a block diagram illustrating operation of an image management program employed in the personal computer of FIG. 1.
Figure 9:
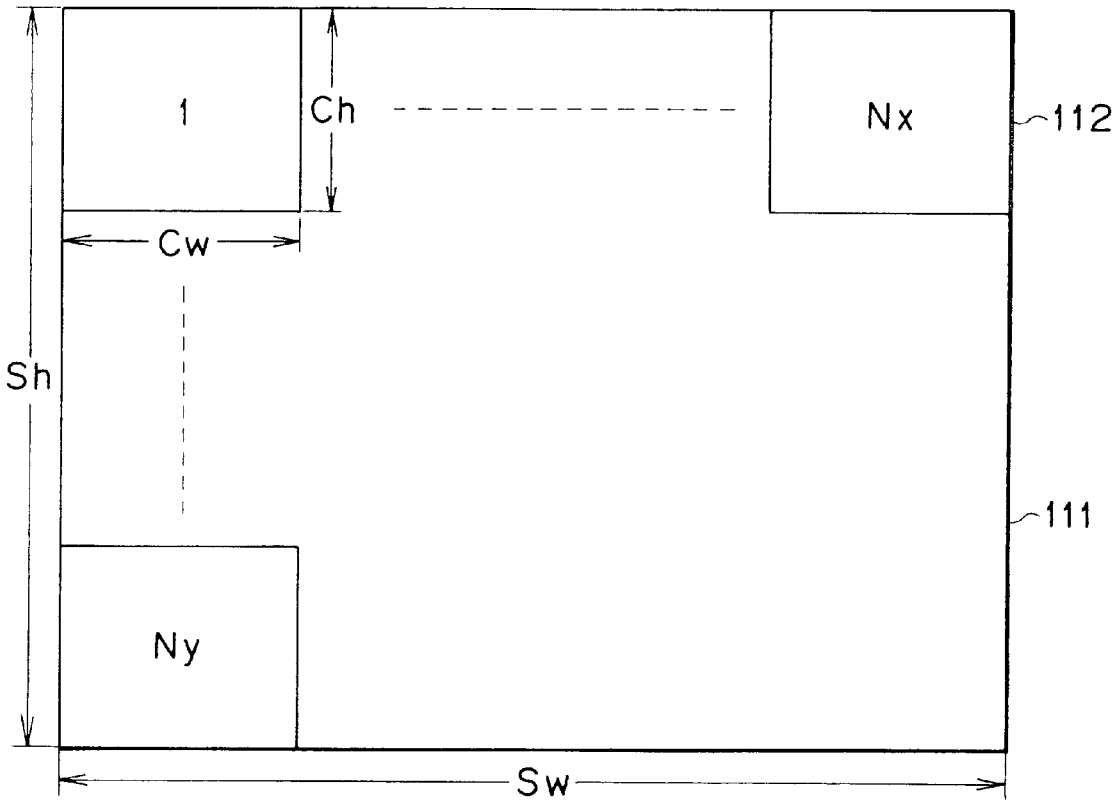
FIG. 9 is a diagrammatic view illustrating the number of thumbnail images displayed by the personal computer of FIG. 1.

FIG. 8 illustrates an example of a construction of functional blocks of the image management program. Referring to FIG. 8, a setting inputting section 101 detects parameters set by a user and outputs the parameters to an arithmetic section 102.

The parameters outputted from the setting inputting section 101 to the arithmetic section 102 include the size (width Sw and height Sh) of an image display region 111 (second region) in an image management window 121 (FIG. 10) to be displayed on the display part 3, an aspect ratio (Ch/Cw) of thumbnail regions 112 (first region) included in the image display region 111, and a thumbnail number N (=Nx×Ny) to be displayed at a time in the image display region 111.

The arithmetic section 102 calculates the horizontal number Nx' or the vertical number Ny' of the thumbnail regions 112 to be displayed at a time in the image display region 111 using the following expression (1) or (2):

$$Nx' = \sqrt{\frac{Ch}{Cw} \cdot \frac{Sw}{Sh} \cdot N} \tag{1}$$

$$Ny' = \sqrt{\frac{Cw}{Ch} \cdot \frac{Sh}{Sw} \cdot N} \tag{2}$$

The horizontal number Nx' or the vertical number Ny' of the thumbnail regions 112 calculated here is least likely to have an integral value.

A decision section 103 rounds up or down the horizontal number Nx' (or vertical number Ny') of thumbnail regions 112 inputted from the arithmetic section 102 based on a predetermined criterion to convert it into an integral value Nx (or integral value Ny). The decision section 103 further divides the thumbnail number N to be displayed at a time by the integral value Nx (or integral value Ny) to determine an integral value Ny (or integral value Nx).

Further, the decision section 103 divides the width Sw of the image display region 111 by the integral value Nx to determine the width Cw of the thumbnail regions 112 and divides the height Sh by the integral value Ny to determine the height Ch of the thumbnail regions 112. The decision section 103 outputs the thus determined width Cw and height Ch to a display control section 104.

It is to be noted that the decision of which one of the horizontal number Nx' and the vertical number Ny' of the thumbnail regions 112 should be calculated by the arithmetic section 102 and the decision of which one of rounding up and down for conversion into an integral value should be performed by the decision section 103 are performed taking it into consideration in what manner a region in which no thumbnail image is displayed (a surplus region which appears as a result of rounding) is preferably displayed in the image display region 111. For example, where "the image display region 111 is horizontally elongated and may have a surplus region in a horizontal direction whereas the image display region 111 should have a possible minimum surplus region in a vertical direction", the horizontal number Nx' is calculated and the thus calculated value Nx' is rounded down.

The display control section 104 reads out image data stored in a storage section 105 (which corresponds to the hard disk drive 56 of FIG. 7), reduces the size of images of the image data so that each image may remain within a thumbnail region 112 having the width Cw and the height Ch inputted thereto from the decision section 103 to produce a thumbnail image, and causes the thumbnail image to be displayed in the image display region 111 of the image management window 121 which is hereinafter described with reference to FIG. 10. Further, the display control section 104 enlarges or reduces the thumbnail regions 112 (thumbnail images) of the image display region 111 in response to the position of a zoom bar 123 (FIG. 10) which is operated by a user. Upon such enlargement or reduction, the aspect ratio Ch/Cw of the thumbnail regions 112 does not. vary.

The storage section 105 stores image data in folders having a hierarchical structure.

Figure 10:
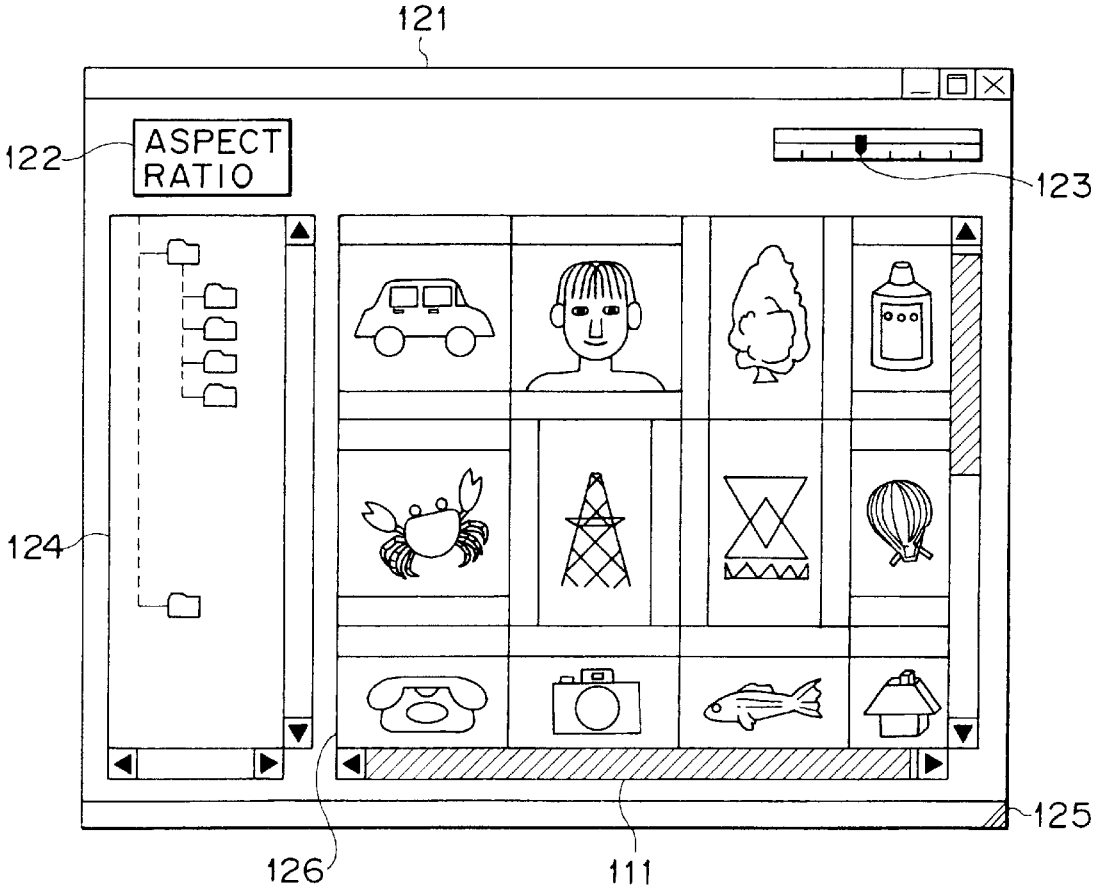
FIG. 10 is a schematic view showing an image management window displayed by the personal computer of FIG. 1.

FIG. 10 shows the image management window 121 displayed on the display part 3. When an aspect ratio button 122 is clicked, an aspect ratio setting window (not shown) for inputting a set value of the aspect ratio of the thumbnail regions 112 therethrough is displayed.

The zoom bar 123 designates, with the position thereof, the size of the thumbnail regions 112 (thumbnail images) in the image display region 111, and as the position of the zoom bar 123 is moved, the size of the thumbnail regions 112 (thumbnail images) is increased or decreased. A folder list display region 124 hierarchically displays the folders stored in the storage section 105 and having image data stored therein. When one of the folders displayed in the folder list display region 124 is clicked, thumbnail images of the image data stored in the clicked folder are displayed in the image display region 111. In particular, the number of image data stored in the clicked folder is detected as the thumbnail number N to be displayed at a time in the image display region 111 described above by the setting inputting section 101.

If an image management window corner 125 is dragged, then the size of the image management window 121 on the display part 3 is increased or decreased at an arbitrary ratio. Upon such expansion or reduction of the image management window 121, also the size of the image display region 111 is increased or decreased. On the other hand, if a framework line 126 of the image display region 111 is dragged within the range of the image management window 121, the size of the image display region 111 is increased or decreased within the image management window 121.

In FIG. 10, it is shown that thumbnail regions 112 (thumbnail images) expanded in response to the position of the zoom bar 123 are displayed in the image display region 111.

Figure 11:
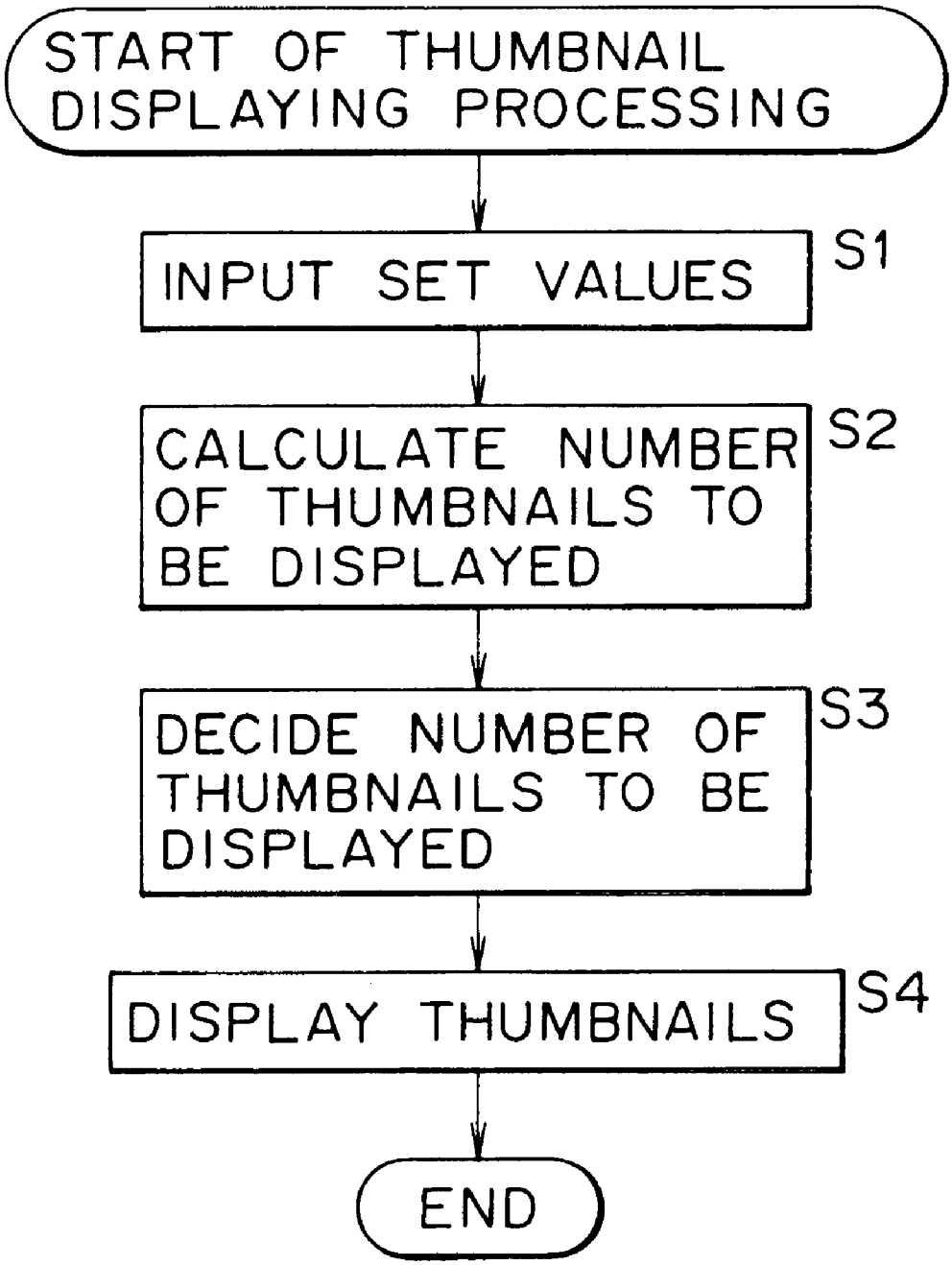
FIG. 11 is a flow chart illustrating thumbnail image displaying processing of the image management program illustrated in FIG. 8.

Now, thumbnail image displaying processing of the image management program is described with reference to a flow chart of FIG. 11. When execution of the image management program is started in response to a predetermined starting operation of a user, an image management window 121 is displayed on the display part 3.

In step S1, if the user selects one of folders displayed in the folder list display region 124 of the image management window 121 displayed on the display part 3, then information of the selected folder (the thumbnail number N stored in the folder) is detected by the setting inputting section 101.

Further, if the user operates the aspect ratio button 122 to cause an aspect ratio setting window to be displayed and inputs an arbitrary aspect ratio Ch/Cw for thumbnail regions 112, then the inputted value is detected by the setting inputting section 101. When the user further operates the image management window corner 125 or framework line 126 to change the size of the image display region 111, the information (height Sh and width Sw) is detected by the setting inputting section 101.

The setting inputting section 101 outputs the thus detected thumbnail number N, aspect ratio Ch/Cw, and size (height Sh and width Sw) of the image display region 111 to the arithmetic section 102. If the aspect ratio of the thumbnail regions 112 or the image display region 111 is not set, then a predetermined initial value therefor is outputted to the arithmetic section 102.

In step S2, the arithmetic section 102 calculates the horizontal number Nx' of the thumbnail regions 112, for example, using the expression (1) given hereinabove if the image display region 111 is horizontally elongated, and outputs the calculated horizontal number Nx' to the decision section 103.

In step S3, if the criterion set in advance is that, where "the image display region 111 is horizontally elongated and may have a surplus region in a horizontal direction whereas the image display region 111 should have a possible minimum surplus region in a vertical direction", the horizontal number Nx' is calculated and the calculated value of the horizontal number Nx' is rounded down, then the decision section 103 rounds down the horizontal number Nx' based on the criterion to convert it into an integral value Nx and divides the thumbnail number (the number of images stored in the folder) N by the integral value Nx' to determine an integral value Ny.

Further, the decision section 103 divides the width Sw of the image display region 111 by the integral value Nx to determine a width Cw of the thumbnail regions 112 and divides the height Sh by the integral value Ny to determine a height Ch of the thumbnail regions 112, and outputs the thus determined values of the height Ch and the width Cw to the display control section 104.

In step S4, the display control section 104 successively reads out the image data stored in the folder selected in step S1 from the storage section 105, reduces the size of images of the image data so that each of the images may remain within a thumbnail region 112 having the width Cw and the height Ch inputted from the decision section 103 to produce thumbnail images, and causes the produced thumbnail images to be displayed in the thumbnail regions 112 of the image display region 111.

Since N thumbnail images are displayed in the image display region 111, it can be recognized readily what image data are stored in the selected file.

If the user operates the zoom bar 123 in this state, then the thumbnail regions 112 (thumbnail images) displayed in the image display region 111 are enlarged or reduced in response to the position of the zoom bar 123. Accordingly, details of the images of the image data can be confirmed by expanding the thumbnail images.

It is to be noted that, upon such expansion or reduction, the aspect ratio Ch/Cw of the thumbnail regions 112 does not vary. Further, upon expansion, the number of thumbnail images to be displayed at a time decreases from N.

While, in the embodiment described above, the image data stored in the storage section 105 are picked up by the CCD video camera 23, for example, image data acquired through the Internet 92 may naturally be stored into the storage section 105.

Further, since the information processing apparatus takes the size (aspect ratio) of the image display region 111 into consideration, it is possible to effectively utilize the display area of a display unit which does not have a standard aspect ratio.

Further, if the present invention is applied, for example, to a multi-view mode wherein a plurality of broadcasting programs are displayed in a list on a television receiver which receives multiple channel television broadcastings, the screen can be utilized efficiently in accordance with the number of programs to be displayed at a time.

It is to be noted that a computer program for causing a computer to execute such processes as described above can be provided to a user not only as a providing medium in the form of an information recording medium such as a magnetic disk or a CD-ROM but also through an network providing medium such as the Internet or a digital satellite.

While a preferred embodiment of the present invention has been described using specific terms, such description is for illustrative purposes only, and it is to be understood that changes and variations may be made without departing from the spirit or scope of the following claims.

What is claimed is:

1. A plural image displaying method, comprising the steps of:

setting an aspect ratio for a plurality of images;

setting an aspect ratio of a region in which the plurality of images should be displayed;

detecting the number of the images to be displayed in the region;

determining, from the aspect ratio for the plurality of images, the aspect ratio of the region and the number of the images, a size of the images when the images should be displayed in the region; and displaying the plurality of images with the determined size in the region.

2. A plural image displaying method according to claim 1, wherein the aspect ratio for the plurality of images is determined from a vertical length and a horizontal length of each of the plurality of images.

3. A plural image displaying method according to claim 1, wherein the aspect ratio of the region in which the plurality of images should be displayed is determined from a vertical length and a horizontal length of the region in which the plurality of images should be displayed.

4. A plural image displaying method according to claim 1, wherein the number of the images to be displayed in the region is the number of image files included in a predetermined folder.

5. A plural image displaying method according to claim 3, wherein the vertical length and the horizontal length of the region in which the plurality of images should be displayed are individually variable.

6. A plural image displaying apparatus, comprising:

a display screen;

means for providing information of a plurality of images to be displayed on said display screen;

means for setting an aspect ratio for the plurality of images;

means for setting an aspect ratio of a region of said display screen in which the plurality of images should be displayed;

means for detecting the number of the images to be displayed in the region;

means for determining, from the aspect ratio for the plurality of images, the aspect ratio of the region and the number of the images, a size of the images when the images should be displayed in the region; and control means for controlling said display screen to display the plurality of images with the determined size in the region.

7. A plural image displaying apparatus according to claim 6, wherein the aspect ratio for the plurality of images is determined from a vertical length and a horizontal length of each of the plurality of images.

8. A plural image displaying apparatus according to claim 6, wherein the aspect ratio of the region in which the plurality of images should be displayed is determined from a vertical length and a horizontal length of the region in which the plurality of images should be displayed.

9. A plural image displaying apparatus according to claim 6, wherein the number of the images to be displayed in the region is the number of image files included in a predetermined folder.

10. A plural image displaying apparatus according to claim 8, wherein the vertical length and the horizontal length of the region in which the plurality of images should be displayed are individually variable.

11. A providing medium which provides a computer-readable program for causing an information processing apparatus to execute a process comprising the steps of:

setting an aspect ratio for a plurality of images;

setting an aspect ratio of a region in which the plurality of images should be displayed;

detecting the number of the images to be displayed in the region;

determining, from the aspect ratio for the plurality of images, the aspect ratio of the region and the number of the images, a size of the images when the images should be displayed in the region; and displaying the plurality of images with the determined size in the region.

12. A providing medium according to claim 11, wherein the aspect ratio for the plurality of images is determined from a vertical length and a horizontal length of each of the plurality of images.

13. A providing medium according to claim 11, wherein the aspect ratio of the region in which the plurality of images should be displayed is determined from a vertical length and a horizontal length of the region in which the plurality of images should be displayed.

14. A providing medium according to claim 11, wherein the number of the images to be displayed in the region is the number of image files included in a predetermined folder.

15. A providing medium according to claim 13, wherein the vertical length and the horizontal length of the region in which the plurality of images should be displayed are individually variable.

* * * * *